US005980372A

United States Patent [19]

Spishak

[11] Patent Number: 5,980,372

[45] Date of Patent: Nov. 9, 1999

[54] COMPACT CATCHER FOR ABRASIVE WATERJETS

[75] Inventor: Noel A. Spishak, Bellevue, Wash.

[73] Assignee: The Boeing Company, Seattle, Wash.

[21] Appl. No.: 08/978,447

[22] Filed: Nov. 25, 1997

[51] Int. Cl.[6] ..... B24B 55/12

[52] U.S. Cl. ..... 451/453; 83/177; 451/87

[58] Field of Search ..... 83/53, 177; 451/38, 451/39, 40, 75, 87, 442, 453, 457

[56] References Cited

U.S. PATENT DOCUMENTS

| | | | |
|---|---|---|---|
| 3,730,040 | 5/1973 | Chadwick et al. | 83/177 |
| 3,978,748 | 9/1976 | Leslie et al. | 83/177 |
| 4,435,902 | 3/1984 | Mercer et al. | 83/177 X |
| 4,463,639 | 8/1984 | Gerber | 83/177 X |
| 4,501,182 | 2/1985 | Jardat et al. | 83/177 |
| 4,651,476 | 3/1987 | Marx et al. . | |
| 4,669,229 | 6/1987 | Ehlbeck . | |
| 4,698,939 | 10/1987 | Hashish | 451/87 |
| 4,799,415 | 1/1989 | Gerdes | 83/177 |
| 4,827,679 | 5/1989 | Earle, III | 83/177 X |
| 4,847,954 | 7/1989 | Lapeyre et al. | 83/177 X |
| 4,848,042 | 7/1989 | Smith et al. | 83/177 X |
| 4,864,780 | 9/1989 | Ehlbeck et al. . | |
| 4,872,293 | 10/1989 | Yasukawa et al. . | |
| 4,920,841 | 5/1990 | Johnson | 83/177 |
| 4,937,985 | 7/1990 | Boers et al. . | |
| 4,964,244 | 10/1990 | Ehlbeck . | |
| 5,487,629 | 1/1996 | Watanabe . | |

FOREIGN PATENT DOCUMENTS

| | | | |
|---|---|---|---|
| 2022789 | 2/1992 | Canada | 83/177 |
| 1143458 | 1/1953 | France | 83/177 |
| 2647049 | 11/1990 | France | 83/177 |
| 296031 | 11/1991 | Germany | 83/177 |
| 1504017 | 8/1989 | U.S.S.R. | 83/177 |

*Primary Examiner*—Timothy V. Eley
*Attorney, Agent, or Firm*—Christensen O'Connor Johnson & Kindness PLLC

[57] ABSTRACT

A compact catcher assembly (20) for an abrasive waterjet having a nozzle assembly (22) and a jewel orifice (not shown) for producing a high velocity fluid jet (26) to cut a workpiece within a small area in which to receive the catcher assembly, such as between the upper and lower flanges (28) and (30) of an I-beam (32). The catcher assembly includes a deflector block (42) having an upper surface (62) defining a perimeter, a lower surface (64), and a cylindrical side surface (60) vertically spacing the upper surface from the lower surface. The upper surface has a vertically extending first inlet port (68), while the side surface defines a first exhaust port (74) extending horizontally through the side surface. The deflector block includes an inlet channel (66) extending normally from said entry port to a predetermined distance within the deflector block to define a bottom surface (70) opposite the entry port. The deflector block also includes a first exit channel (72) extending from the exit port and intersecting the inlet channel at a predetermined distance from the bottom of the inlet channel to define a cushion cavity (76) between the intersection and the bottom to dissipate the kinetic energy of the fluid.

5 Claims, 1 Drawing Sheet

COMPACT CATCHER FOR ABRASIVE WATERJETS

FIELD OF THE INVENTION

The present invention relates generally to fluid jet cutting systems and, in particular, to a compact catcher for abrasive waterjets.

BACKGROUND OF THE INVENTION

Cutting by means of a high velocity fluid jet is well known in the art. Typically, a fluid, such as water, is forced through a jewel orifice to generate a jet having a pressure from 35,000 to 55,000 psi and a velocity of up to three times the speed of sound. Such a jet may be utilized to cut through a variety of nonmetallic materials such as rubber, plastic, wood, or cloth. The cutting power of the fluid jet may be enhanced by the addition of abrasive particles into the high pressure stream to produce an abrasive waterjet. Abrasive waterjets are effective at cutting a wide variety of metals, such as steel, aluminum and titanium, hard non-metallics, such as rock and concrete, and exceptionally hard materials, such as armor plate, certain ceramics, and tool steel. Typically, abrasive materials used in an abrasive waterjet include garnet, silica, and aluminum oxide.

Abrasive waterjets are also effective at cutting graphite-epoxy composite materials, such as composite panels and I-beam stringers for airplane components. Currently, stringers are cut with an extrusion mill having high speed routers to cut the desired profile of the stringers. Although extrusion mills are effective at cutting I-beam stringers, the resulting cut quality is sometimes poor and each stringer must be reworked to smooth the edges. Because of the high cut quality associated with abrasive waterjets, there is no need to rework the workpiece and, therefore, abrasive waterjets have proven to be a very effective cutting tool for composites, such as panels and I-beam stringers.

In the past, a significant limitation of abrasive waterjets was the size of the catcher to catch or stop the waterjet stream after it has cut through the workpiece. Because of the high fluid pressure associated with waterjets, the waterjet cutting stream is a danger to persons or equipment that may accidentally be impinged by the waterjet. Accordingly, waterjet cutting systems have included an energy dissipating receptacle for receiving the high velocity jet of fluid.

Energy dissipating receptacles, or catchers, currently known in the art suffer from three basic problems. First, conventional catchers, particularly those used with abrasive waterjets, have experienced short useful lives because of the cutting force of the jet and have required relatively expensive wear components. Thus, catchers currently available are usually expensive and require frequent replacements.

Second, the catcher housing has typically been expensive because of the quality and quantity of material from which it is fabricated. Thick metallic walls are required to ensure against penetration by the fluid jet, particularly where abrasive waterjets are utilized. Thirdly, the catcher is typically too large to fit within workpieces having relatively small spacing in which the catcher may be received, such as the vertical spacing between the upper and lower flanges of some I-beam stringers. For example, conventional catchers, such as those disclosed in U.S. Pat. No. 4,651,476 issued to Marx et al., range in length from 4 inches up to 36 inches in the direction of the jet travel. Thus, waterjets cannot be used to cut a workpiece having an available space in which the catcher may be received that is smaller than 4 inches because currently available catchers are too large. In summary, catchers currently available in the art not only have short useful lives, but also are relatively large and expensive.

Thus, there exists a need for a catcher that is both inexpensive and durable to deflect and dissipate the energy from an abrasive waterjet stream, while being sized to fit within a relatively small cutting area. The present invention addresses these issues and other issues to overcome the limitations currently encountered by providing a compact catcher that includes an angled channel to dissipate the energy associated with a high pressure waterjet within a predetermined area.

SUMMARY OF THE INVENTION

The present invention is a compact catcher for a high pressure stream of abrasive fluid from a waterjet nozzle. The preferred embodiment of the compact catcher includes a housing having an upper surface defining a first entry port and a side surface substantially normal to the upper surface having at least one exit port. The compact catcher includes an inlet channel extending from the entry port to a predetermined distance within the housing to define a bottom therein that is opposite the entry port. The compact catcher also includes at least one exit channel extending from the exit port and intersecting the inlet channel at a predetermined distance from the bottom of the inlet channel, thereby defining a cushion cavity therebetween to dissipate the kinetic energy of the fluid flowing through the catcher.

In a further aspect of the present invention, the first entry hole has a diameter that is substantially equal to or slightly larger than the diameter of the fluid stream to prevent backsplash of the fluid stream.

In yet another aspect of the present invention, the compact catcher includes a plurality of steel balls disposed within an internal cavity positioned adjacent the exit port of the compact catcher, such that the balls will absorb energy from the stream of fluid exiting from the compact catcher.

The compact catcher of the present invention provides several advantages over catchers currently available in the art for abrasive waterjets. The catcher of the present invention uses a cushion cavity at the end of the inlet channel to collect the abrasive particles of an abrasive waterjet and absorb a substantial amount of kinetic energy of the incoming fluid jet. Because the incoming fluid jet impinges the abrasive particles first, the abrasive particles absorb a substantial amount of the fluid jet's eroding kinetic energy and, therefore, substantially extends the useful life of the catcher. Also, because the catcher of the present invention has an extended useful life, it does not have to be replaced as often and, therefore, is less expensive than those currently available. The compact catcher of the present invention also has the added advantage of dissipating energy from a jet stream of water in a distance that is smaller than that currently available in the art because of its angled flow passage. These advantages combine to define a compact catcher that is less expensive than those currently available and has a longer useful life, while providing greater flexibility for use in smaller areas than catchers currently available in the art.

BRIEF DESCRIPTION OF THE DRAWINGS

The foregoing aspects and many of the attendant advantages of this invention will become better understood by reference to the following detailed description, when taken in conjunction with the accompanying drawings, wherein.

DETAILED DESCRIPTION OF THE PREFERRED EMBODIMENT

Figure 1:
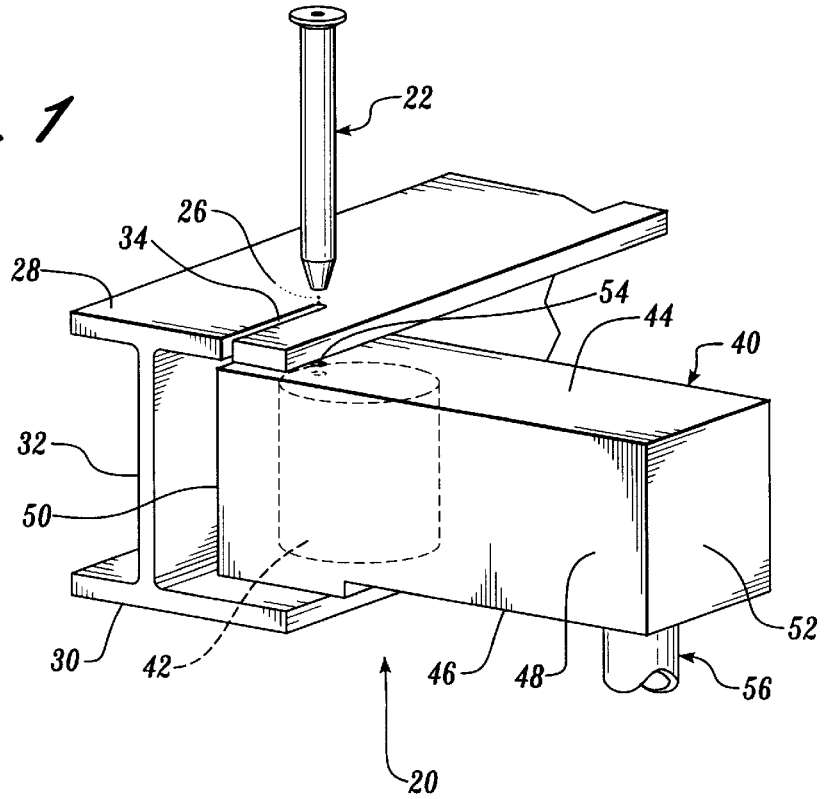
FIG. 1 is a perspective view of a compact catcher assembly of the present invention as it would be used in cutting an I-beam stringer.

FIG. 1 illustrates a preferred embodiment of a compact catcher assembly 20 constructed in accordance with the present invention. The catcher assembly 20 is shown in the preferred embodiment as it would be used in a fluid jet cutting system (not shown) having a downwardly depending nozzle assembly 22. The catcher assembly 20 is removably attached to the fluid jet cutting system by conventional brackets and fasteners (not shown), and is positioned directly beneath the nozzle assembly 22. The nozzle assembly 22 includes a jewel orifice (not shown) for producing a high velocity fluid jet 26 to cut a workpiece, illustrated in FIG. 1 as a composite I-beam 32. The beam 32 includes an upper flange 28 and a lower flange 30 that are to be trimmed by the fluid jet 26.

Typically, the fluid jet 26 is a stream of water injected with abrasive particles, such as garnet, and is known in the art as an abrasive water jet. The nozzle assembly 22 has an exit port (not shown) defined in its free end. The exit port has a diameter that ranges between 0.020 inches to 0.070 inches or more, to produce a stream of fluid having a pressure of up to 55 kilo-pounds per square inch and a velocity of up to three times the speed of sound to cut through a variety of materials, such as metals, composites, and concrete. Because of the high fluid pressure, the catcher assembly 20 must be adapted to receive and dissipate the kinetic energy of the fluid jet 26 after it cuts the beam 32, as described in greater detail below.

The beam 32 is supported on guide assemblies (not shown), such that it may pass, either manually or automatically, underneath the fluid jet 26 without vibration or deflection while it is being cut. In the preferred embodiment, the upper flange of the beam 32 is horizontally translated between the catcher assembly 20 and the nozzle 24, such that the upper flange 28 passes normal to the direction of the fluid jet 26. The fluid jet 26 cuts the upper flange 28 along the length of the beam 32 to define a cut line 34. Although it is preferred that the fluid jet 26 cuts along the longitudinal direction, other cutting directions, such as a circular pattern for a pipe or a transverse pattern, are also within the scope of the invention. Furthermore, even though it is preferred that the workpiece is translated relative to the fluid jet 26, it may be desirable for the workpiece to remain stationary while the fluid jet cutting system translates the catcher and nozzle assemblies 20 and 22 along a desired cutting path.

During the cutting process, fluid jet 26 passes through upper flange 28 and enters catcher assembly 20. Catcher assembly 20 includes a rectangular housing 40 and a deflector block 42 that is sized to be received within one end of the housing 40. The housing 40 is manufactured from a high strength material, such as steel, stainless steel or iron, and includes an upper surface 44, a lower surface 46, and opposing first and second ends 48 and 50. The first end 48 of the housing 40 is sealed by a first end plate 52 that is rigidly attached to the housing 40 by well known fastening means, such as welding. The second end 50 is sealed by a second end plate (not shown) that is removably fastened to the housing 40 by well known fasteners (not shown), such as nuts and bolts, to facilitate easy removal and replacement of the deflector block 42, as described in greater detail below.

The upper surface 44 of the housing 40 also has a vertically extending inlet bore 54 positioned near the second end 50. The inlet bore 54 is positioned to receive the fluid jet 26 after it has passed through the upper flange 28, and has a diameter that is slightly larger than the diameter of the fluid jet 26 by a predetermined amount, such that the fluid jet 26 is receivable therein without impinging on the upper surface 44. A drainage tube 56 depends downwardly from the lower surface 46 adjacent the first end 48 of the housing 40. The drainage tube 56 permits the fluid to drain from the housing 40 after the catcher assembly 20 has absorbed a substantial amount of the kinetic energy of the fluid jet 26, as described in greater detail below.

The upper and lower surfaces 44 and 46 of the housing 40 are spaced in the vertical direction such that the housing 40 may be slideably received between the upper and lower flanges 28 and 30 of the beam 32 without contacting either flange. Preferably, the vertical distance between the upper and lower surfaces 44 and 46 is at least one inch. However, in some versions of the invention, it may be desirable to reduce the vertical spacing between the upper and lower surfaces 44 and 46 to less than one inch, thereby accommodating a workpiece having a cutting area that is even more restricted than that defined between the upper and lower flanges 28 and 30 of the preferred embodiment.

Figure 2:
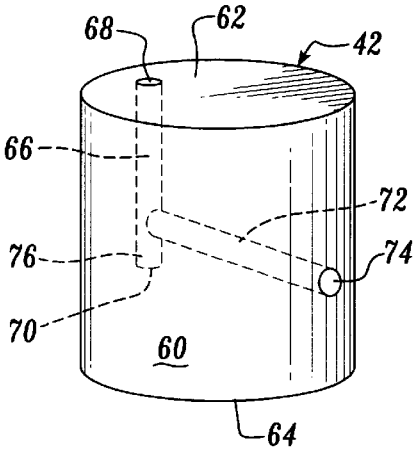
FIG. 2 is a perspective view of the compact catcher of the present invention showing an inlet channel, a cushion cavity, and an exit channel.

Referring now to FIG. 2, and as briefly noted above, the catcher assembly 20 includes a deflector block 42 manufactured from a high strength and abrasion resistant material, such as carbide. The deflector block 42 includes a cylindrical sidewall 60 vertically spacing an upper surface 62 from a lower surface 64 to define a solid cylindrical block that is sized to fit within the second end 50 of the housing 40. The deflector block 42 also has a vertical inlet channel 66 extending downwardly from the upper surface 62. The inlet channel 66 defines an inlet port 68 at the upper surface 62 and extends normally from the inlet port 68 downwardly to within a predetermined distance from the lower surface 64 where it terminates in a bottom end or surface 70. The inlet port 68 is positioned on the upper surface 62 such that it coaxially aligns with the inlet bore 54 of the housing 40 when the deflector block 42 is positioned within the housing 40. Inlet port 68 and inlet channel 66 are preferably dimensioned substantially equal to or just slightly larger than the diameter of the fluid jet 26, thereby closely surrounding the fluid jet 26 and preventing fluid backsplash. The inlet channel 66 permits the fluid to pass into the deflector block 42 and exit out of the deflector block 42 through an outlet channel 72.

The outlet channel 72 is located between the upper and lower surfaces 62 and 64 of the deflector block 42 and extends inwardly from an exhaust port 74 defined in the sidewall 60 to a location where it intersects only one side of the inlet channel 66. The channel 72 intersects the inlet channel 66 at a predetermined distance above the bottom surface 70 of the inlet channel 66 to define a cushion cavity 76 in the region between the bottom surface 70 and the intersection of the inlet and outlet channels 66 and 72. Preferably, the outlet channel 72 intersects the inlet channel 66 at or close to a right angle to form a substantially L-shaped flow passage between the inlet and exhaust ports 68 and 74, with the cushion cavity 76 depending downwardly from the spine thereof. The inlet and outlet channels 66 and 72 may intersect at any of a variety of oblique angles, such that the outlet channel 72 angles either upwardly or downwardly relative to a horizontal plane defined by the upper surface 62.

Figure 3:
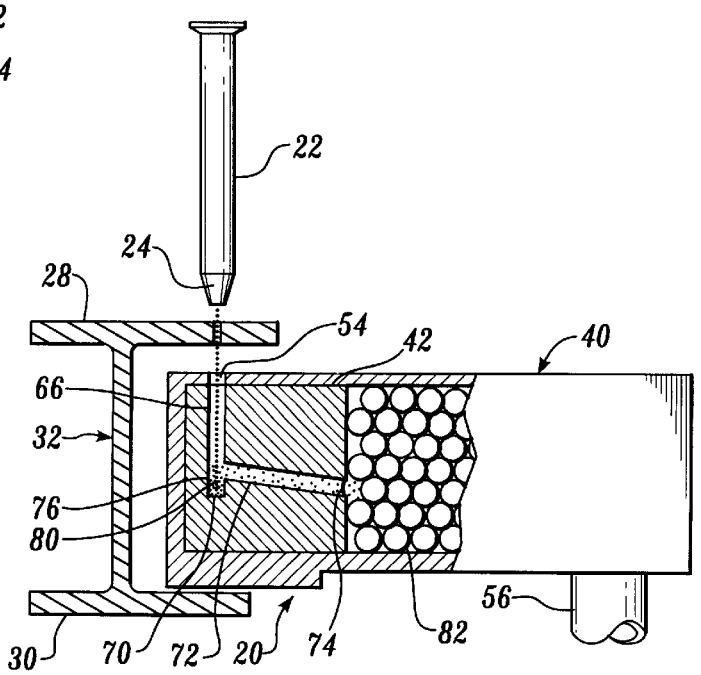
FIG. 3 is a partial cut away of the compact catcher assembly and includes the compact catcher of the present invention and energy dissipating steel balls.

Operation of the catcher assembly 20 may be best understood by referring to FIG. 3. As described above, the upper flange 28 of beam 32 is inserted and translated between the catcher assembly 20 and the nozzle 24. The high pressure of the fluid jet 26 is directed normal to the horizontal plane defined by the length of the upper flange 28 and cuts the flange along the cut line 34. After the fluid jet 26 cuts the upper flange 28, it passes through the inlet bore 54 of the housing 40 and into the inlet channel 66 of the deflector block 42, where the fluid jet 26 is received within the cushion cavity 76 and strikes the bottom surface 70 thereof. When the fluid jet 26 hits the bottom surface 70 of the inlet channel 66, the abrasive particles 80 from the waterjet at least partially fill the cushion cavity 76 and serve as a cushion for the subsequent abrasive particles. The continuous build up and erosion of the abrasive particles significantly slows further erosion of the cavity 76 because the fluid jet 26 strikes against the abrasive particles 80 instead of striking only against the bottom surface 70 of the inlet channel 66. Because the fluid jet 26 impinges first against the abrasive particles 80, the abrasive particles 80 absorb a substantial amount of the kinetic energy from fluid jet 26, with at least a portion of the remaining energy being absorbed by the bottom surface 70 of the inlet channel 66.

Backsplash of the fluid back through the inlet channel 66 is prevented because the diameter of the inner channel 66 being sized to substantially the same diameter as the incoming fluid jet 26, such that the incoming fluid substantially occupies the entire cross sectional area of the inlet channel 66, and thus, chokes or prevents fluid from backing up through the inlet channel 66. Furthermore, because a substantial amount of the kinetic energy of fluid jet 26 has been absorbed, it has a velocity that is less than the incoming fluid and, therefore is unable to overcome the velocity of the incoming fluid and is forced out of the deflector block 42 through the outlet channel 72.

Still referring to FIG. 3, the fluid jet 26 passes through the outlet channel 72 and exits the deflector block 40 through the exhaust port 74, where it impinges on a plurality of balls 82 made from a high strength and hard material, such as steel or ceramic, disposed within the first end of the housing 40, adjacent the exhaust port 74. The balls 82 serve to absorb additional kinetic energy of the fluid jet 26 before the dissipated fluid exits the housing 40 through the drainage tube 56.

The previously described version of the present invention provides several advantages over catcher assemblies for abrasive water jets currently available in the art. The catcher of the present invention uses a cushion cavity at the end of the inlet channel to collect the abrasive particles of an abrasive waterjet and absorb a substantial amount of kinetic energy of the incoming fluid jet. Because the incoming fluid jet impinges the abrasive particles first, the abrasive particles absorb a substantial amount of the fluid jet's eroding kinetic energy and, therefore, substantially extends the useful life of the catcher. Also, because the catcher of the present invention has an extended useful life, it does not have to be replaced as often and is less expensive than those currently available. The compact catcher of the present invention also has the added advantage of dissipating energy from a jet stream of water in a distance that is smaller than that currently available in the art because of its angled flow passage. Thus, these advantages combine to define a compact catcher that provides the capability to cut where a small catcher height is required, and is less expensive than those currently available; and has a longer useful life, while providing greater flexibility for use in smaller areas than catchers currently available in the art.

From the foregoing description, it may be seen that the catcher of the present invention incorporates many novel features and offers significant advantages over those currently available in the art. It will be apparent to those of ordinary skill that the embodiment of the invention illustrated and described herein are exemplary only. As a non-limiting example, there may be more than one outlet channels and exhaust ports intersecting the inlet channel, such that there are multiple exits to facilitate a more rapid exhaust of the fluid through the deflector block. Also, although it is preferred that the deflector block is shaped as a cylindrical block, other shapes, such as square or rectangle, are also within the scope of the invention. Therefore, changes may be made to the foregoing embodiment while remaining within the spirit and scope of the present invention.

The embodiments of the invention in which an exclusive property or privilege is claimed are defined as follows:

1. A compact catcher for a waterjet nozzle, said compact catcher comprising:

(a) a deflector block of abrasion resistant material having an upper surface defining a perimeter, a lower surface, and at least one side surface vertically spacing said upper surface from said lower surface, said upper surface having a first entry port for receiving a high pressure stream of fluid of a predetermined diameter from said waterjet nozzle, said first entry port being spaced inwardly from said perimeter, said side surface having a first exit port extending horizontally therethrough;

(b) an inlet channel extending downwardly from said entry port to a predetermined position within said housing, said inlet channel having a bottom located opposite said entry port, said inlet channel having a diameter substantially equal to said diameter of said fluid to prevent backsplash of said stream of fluid;

(c) at least one exit channel extending inwardly from said exit port and intersecting said inlet channel a predetermined distance above said bottom of said inlet channel to define a cushion cavity between said intersection and said bottom to dissipate kinetic energy from said fluid, wherein said deflector block is sized to fit within a predetermined small work area of a workpiece, wherein said workpiece is an I-beam having an upper flange and a lower flange, said compact catcher being sized to fit between said upper and lower flanges;

(d) a recovery vessel having an internal cavity sized to receive said deflector block therein, and having an upper surface and a lower surface, said deflector block being positioned in one end of said vessel, said upper surface of said vessel having an inlet for admitting said stream of fluid, and said lower surface having an outlet for discharging from said vessel; and (e) a plurality of balls disposed within said internal cavity of said vessel and positioned adjacent said exit port of said deflector block, such that said balls will dissipate energy from said stream of fluid exiting from said deflector block.

2. The compact catcher of claim 1, wherein said deflector block is a cylindrical block of high strength material.

3. A compact catcher assembly for a waterjet nozzle, said compact catcher comprising:

(a) a recovery vessel having an internal cavity, an upper surface, and a lower surface, said upper surface having an inlet for admitting said stream of fluid and said lower surface having a first outlet for discharging of the fluid;

(b) a deflector block having a housing with an upper surface defining a perimeter, a lower surface, and a cylindrical side surface vertically spacing said upper surface from said lower surface, said upper surface having a first entry port for receiving a high pressure stream of fluid of a predetermined diameter from said waterjet nozzle, said first entry port being spaced inwardly from said perimeter, said side surface having a first exit port extending horizontally therethrough, said deflector block further comprising:

(i) an inlet channel extending downwardly from said entry port to a predetermined position within said housing, said inlet channel having a bottom located opposite said entry port, said inlet channel having a diameter substantially equal to said diameter of said stream of fluid to prevent backsplash of said stream of fluid; and (ii) at least one exit channel extending inwardly from said exit port and intersecting said inlet channel a predetermined distance above said bottom of said inlet channel to define a cushion cavity between said intersection and said bottom to dissipate kinetic energy from said stream of fluid; and (c) a plurality of high strength balls dispersed within said internal cavity adjacent said outlet.

4. A compact catcher for a high pressure stream of fluid from a waterjet nozzle, said compact catcher comprising:

(a) a deflector block of abrasion resistant material having an upper surface defining a perimeter, a lower surface, and at least one side surface vertically spacing said upper surface from said lower surface, said upper surface having a first entry port for receiving a high pressure stream of fluid of a predetermined diameter from said waterjet nozzle, said first entry port being spaced inwardly from said perimeter, said side surface having a first exit port extending horizontally therethrough;

(b) an inlet channel extending downwardly from said entry port to a predetermined position within said housing, said inlet channel having a bottom located opposite said entry port;

(c) at least one exit channel extending inwardly from said exit port and intersecting said inlet channel a predetermined distance above said bottom of said inlet channel to define a cushion cavity between said intersection and said bottom to dissipate kinetic energy from said fluid, wherein said deflector block is sized to fit within a predetermined small work area of a workpiece, wherein said workpiece is an I-beam having an upper flange and a lower flange, said compact catcher being sized to fit between said upper and lower flanges;

(d) a recovery vessel having an internal cavity sized to receive said deflector block therein, and having an upper surface and a lower surface, said deflector block being positioned in one end of said vessel, said upper surface of said vessel having an inlet for admitting said stream of fluid, and said lower surface having an outlet for discharging from said vessel; and (e) a plurality of balls disposed within said internal cavity of said vessel and positioned adjacent said exit port of said deflector block, such that said balls will dissipate energy from said stream of fluid exiting from said deflector block.

5. A compact catcher assembly for a high pressure stream of abrasive fluid from a waterjet nozzle, said compact catcher comprising:

(a) a recovery vessel having an internal cavity, an upper surface, and a lower surface, said upper surface having an inlet for admitting said stream of fluid and said lower surface having a first outlet for discharging of the fluid;

(b) a deflector block having a housing with an upper surface defining a perimeter, a lower surface, and a cylindrical side surface vertically spacing said upper surface from said lower surface, said upper surface having a first entry port spaced inwardly from said perimeter, said side surface having a first exit port extending horizontally therethrough, said deflector block further comprising:

(i) an inlet channel extending downwardly from said entry port to a predetermined position within said housing, said inlet channel having a bottom located opposite said entry port; and (ii) at least one exit channel extending inwardly from said exit port and intersecting said inlet channel a predetermined distance above said bottom of said inlet channel to define a cushion cavity between said intersection and said bottom to dissipate kinetic energy from said stream of fluid; and (c) a plurality of high strength balls dispersed within said internal cavity adjacent said outlet.

* * * * *